US005363963A

United States Patent [19]

Allen

[11] Patent Number: 5,363,963

[45] Date of Patent: Nov. 15, 1994

[54] DEVICE FOR STORING PHOTOS

[76] Inventor: Tracy L. Allen, 6101 Ivy Glen Dr., Arlington, Tex. 76017

[21] Appl. No.: 137,428

[22] Filed: Oct. 18, 1993

[51] Int. Cl.[5] ..... B65D 85/00; B65D 45/16

[52] U.S. Cl. ..... 206/425; 206/455; 206/449; 220/324

[58] Field of Search ..... 206/449, 424, 451, 425, 206/456, 455

[56] References Cited

U.S. PATENT DOCUMENTS

| | | | |
|---|---|---|---|
| 2,902,996 | 9/1959 | Callen | 206/449 |
| 3,464,579 | 9/1969 | Asenbauer | 220/324 X |
| 3,709,169 | 1/1973 | Gauger, Jr. et al. . | |
| 4,172,332 | 10/1979 | Holes et al. | 40/159 |
| 4,320,591 | 3/1982 | Dorman | 40/398 |
| 4,465,189 | 8/1984 | Molzan | 206/524.8 |
| 5,040,216 | 8/1991 | Policht | 40/357 |
| 5,251,747 | 10/1993 | Hansen et al. | 206/455 X |

*Primary Examiner*—William I. Price
*Attorney, Agent, or Firm*—Michael J. Colitz, Jr.

[57] ABSTRACT

A container system for the storage of photographs and like articles comprising, in combination a container having a lower wall in an octagonal configuration with upstanding rectangular side walls; a cover having an octagonal configuration of a size and shape to overly the container and seal it; a plurality of similarly sized and shaped octagonal support plates, each with eight similar linear segments, each of the segments having a pair of spaced, upstanding pins, the plates adapted to overlie each other in a stacked orientation within the container; a plurality of books of transparent sheets to receive photographs, each book having a spine coupling the sheets, each spine having spaced apertures receivable upon a pair of pins whereby eight books may be positioned and coupled to the pins of the eight segments of each support plate; and a plurality of locking posts equal in number to the segments, each locking post being of a size and shape to correspond to the segments, each locking post having a pair of recesses adjacent to its ends to receive the pins with the spine of a book therebetween.

3 Claims, 3 Drawing Sheets

DEVICE FOR STORING PHOTOS

BACKGROUND OF THE INVENTION

1. Field of the Invention

The present invention relates to storage devices and more particularly pertains to storage devices which may be used for storing photographs.

2. Description of the Prior Art

The use of devices for storing photos is known in the prior art. More specifically, storage devices heretofore devised and utilized for the purpose of storing photos are known to consist basically of familiar, expected and obvious structural configurations, notwithstanding the myriad of designs encompassed by the crowded prior art which have been developed for the fulfillment of countless objectives and requirements.

The prior art discloses a large number of devices for storing photos. By way of example, U.S. Pat. No. 5,040,216 to Stanislaw discloses a photo assembly and package.

U.S. Pat. No. 4,172,332 to Holmes discloses a photo album with cover.

U.S. Pat. No. 4,320,591 to Dorman discloses a flip-type photo album.

U.S. Pat. No. 3,709,169 to Gauger and 4,465,189 to Molzan disclose photo albums which are fireproof and waterproof.

U.S. Pat. No. 5,004,216 to Gordon discloses a design for a photo album.

In this respect, the devices for storing photos according to the present invention substantially departs from the conventional concepts and designs of the prior art, and in so doing provides an apparatus primarily developed for the purpose of storing photos.

Therefore, it can be appreciated that there exists a continuing need for new and improved devices for storing photos which can be constructed to provide efficient storage of photos. In this regard, the present invention substantially fulfills this need.

SUMMARY OF THE INVENTION

In view of the foregoing disadvantages inherent in the known types of devices for storing photos now present in the prior art, the present invention provides an improved device for storing photos construction wherein the same can be utilized for storing photos. As such, the general purpose of the present invention, which will be described subsequently in greater detail, is to provide a new and improved device for storing photos apparatus and method which has all the advantages of the prior art device for storing photos and none of the disadvantages.

To attain this, the present invention essentially comprises a container system for the storage of photographs and like articles comprising, in combination: a container having a lower wall in an octagonal configuration with upstanding rectangular side walls; a cover having an octagonal configuration of a size and shape to overly the container and seal it; a plurality of similarly sized and shaped octagonal support plates, each with eight similar linear segments, each of the segments having a pair of spaced, upstanding pins, the plates adapted to overlie each other in a stacked orientation within the container; a plurality of books of transparent sheets to receive photographs, each book having a spine coupling the sheets, each spine having spaced apertures receivable upon a pair of pins whereby eight books may be positioned and coupled to the pins of the eight segments of each support plate; and a plurality of locking posts equal in number to the segments, each locking post being of a size and shape to correspond to the segments, each locking post having a pair of recesses adjacent to its ends to receive the pins with the spine of a book therebetween.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is a further object of the present invention to provide a new and improved device for storing photos which is of a durable and reliable construction.

An even further object of the present invention is to provide a new and improved device for storing photos which is susceptible of a low cost of manufacture with regard to both materials and labor, and which accordingly is then susceptible of low prices of sale to the consuming public, thereby making such device for storing photos economically available to the buying public.

Still yet another object of the present invention is to provide a new and improved device for storing photos which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
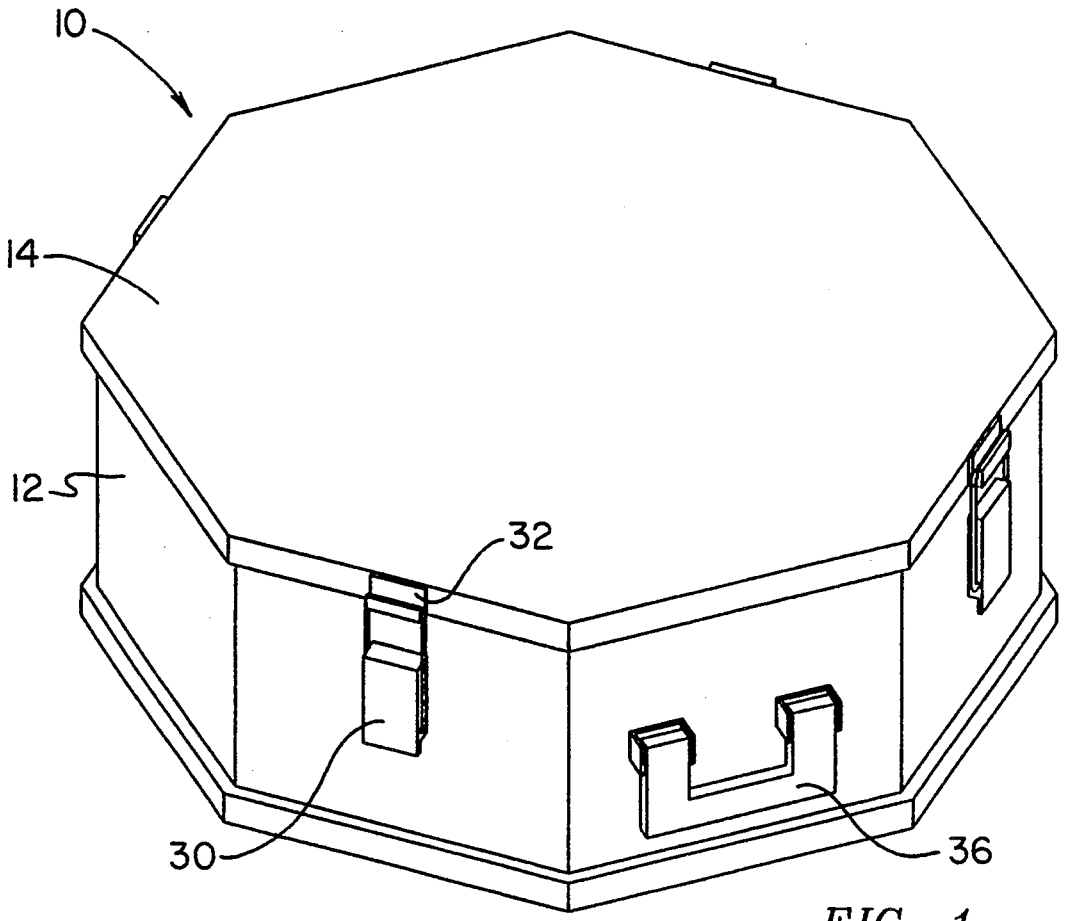
FIG. 1 is a perspective view of the device for storing photos constructed in accordance with the principles of the present invention.

With reference now to the drawings, and in particular to FIG. 1 thereof, a new and improved device for storing photos embodying the principles and concepts of the present invention and generally designated by the reference numeral 10 will be described.

With particular reference to the figures, the major portion of the container system 10 of the present invention include the container 12, the cover 14, the support plates 16, the books 20 and the locking posts 22. These components function together in a systems configuration for the storing of photographs and like articles.

More specifically, the first element of the system is a container 12. The container has a lower wall 24 positionable in a horizontal frame in octangular configuration with 8 equally sized edges with angles therebetween. Upstanding from the periphery of the lower wall are a plurality of upstanding rectangular side walls 26. The side walls have the lower edges coupled to the planar edges of the lower wall at the periphery of the lower wall. The rectangular side walls have their vertical edges coupled one to another to provide a convenient container for the storage of the photographs as will be later described.

The second component of the system is a cover 14. The cover is of a octangular configuration with equally spaced side edges with equal angles there between. It is of a size and shape to fit accurately over the upper edge of the side walls of the container 12. Mutually cooperable clips 30 will make the container cooperate with reception members 32 on the cover for locking the cover to the container. This is desirably done in an air tight, fire proof manner to protect the valuable photographic contents of the container when in use. A complete tight seal is preferred. In addition, a handle 36 is pivotally mounted to the central extent of one of the side walls for carrying the container with the cover 14 thereon and the interior built with photographs.

Figure 5:
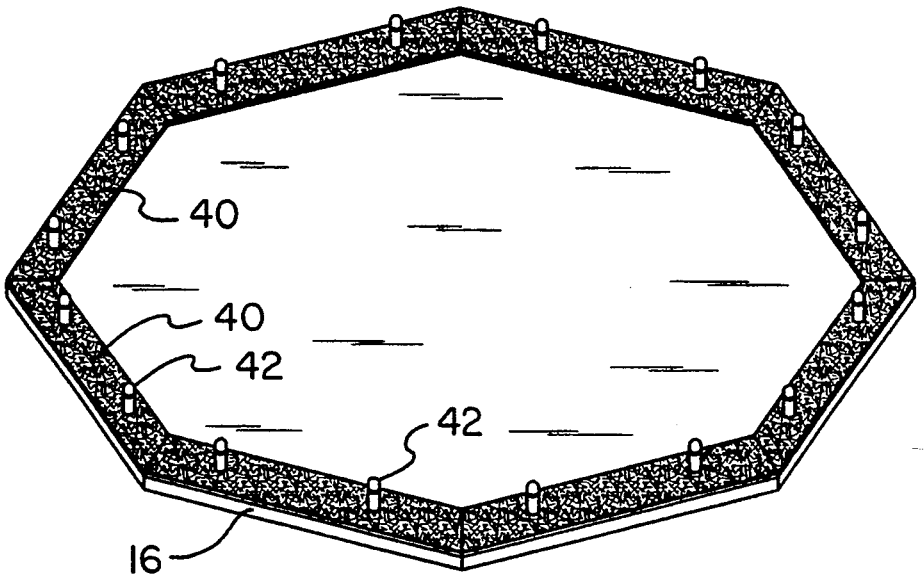
FIG. 5 is a perspective view of one of the coupling rings of FIG. 2.

The next element of the system are a plurality of centrally sized and shaped octangular support plates. One of such plates is shown in FIG. 5. In a normal embodiment five such plates would be provided. Each of the plates 16 is formed of 8 similarly sized and shaped planar segments 40. The planar segments have a trapezoidal shape with a short interior edge along exterior edge and angled in edges there between. The angled end edges of the 8 segments are coupled one to the other in a generally ring shaped configuration.

Figure 6:
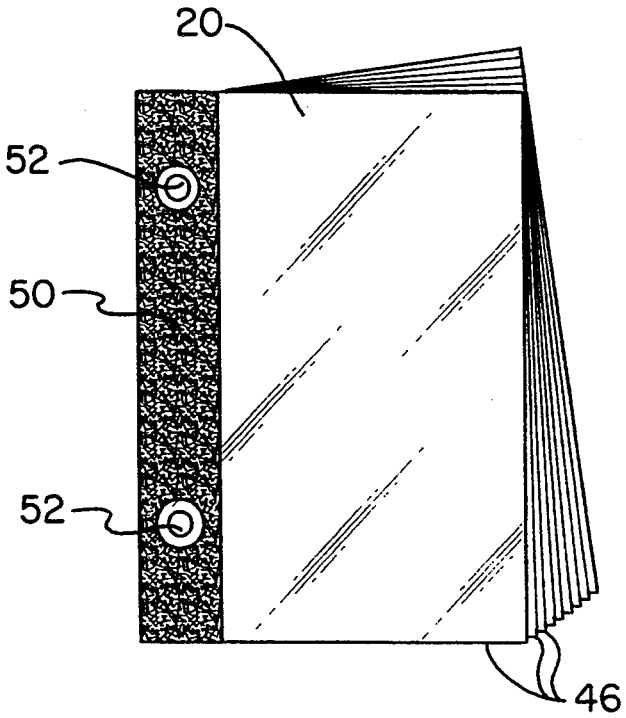
FIG. 6 is a perspective view of one of the books of FIG. 2.

Each of the segments 40 is provided with a pair of spaced upstanding pins 42. The pins extend upwardly a short distance for receiving books or photographs as will be later described. When in use the plates are adapted to overlie one another to hold supported books of photographs in a stacked orientation within the chamber. Consequently the exterior peripheral edge of the ring of the segments is sized to fit snugly within the area mounted by the interior surface of the side walls 26. The next components of the system are the plurality of books 20. Each of the books is formed of a plurality of transparent sheets 46. Note FIG. 6. The sheets are formed in pairs for receiving photographs or other flat articles, souvenirs, mementoes or the like. The sheets of each book are coupled along one long edge by a spine which functions to couple together the sheets. Each spine 50 is provided by a pair of spaced apertures 52. The apertures are of such size as to fit over the pins 42 so that the pins extend upwardly above the spine. The length of each spine is essential to equal the interior parallel edge of its associated segment 40. In this manner, 8 books 20, each with a large number of photographs, may be placed on each ring.

Figure 4:
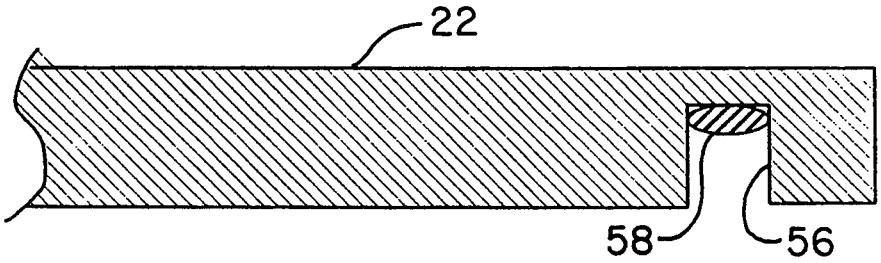
FIG. 4 is a sectional view of the end of a locking post for the device for storing photos of the prior Figure.

The books are secured to each ring by a locking post 22. Each locking post is of a flat elongated configuration with a pair of recesses 56, one at each end sized and spaced to the press fit over the exposed tip of associated pins 42 of each segment. FIG. 4 shows one end of a locking post 22 with a recess 56. The other end of the locking post is of the same configuration. In addition, a circular rubber member 58 may be adhered to the interior wall of the recess 56 for contacting the tip of the associated pin 42.

Figure 2:
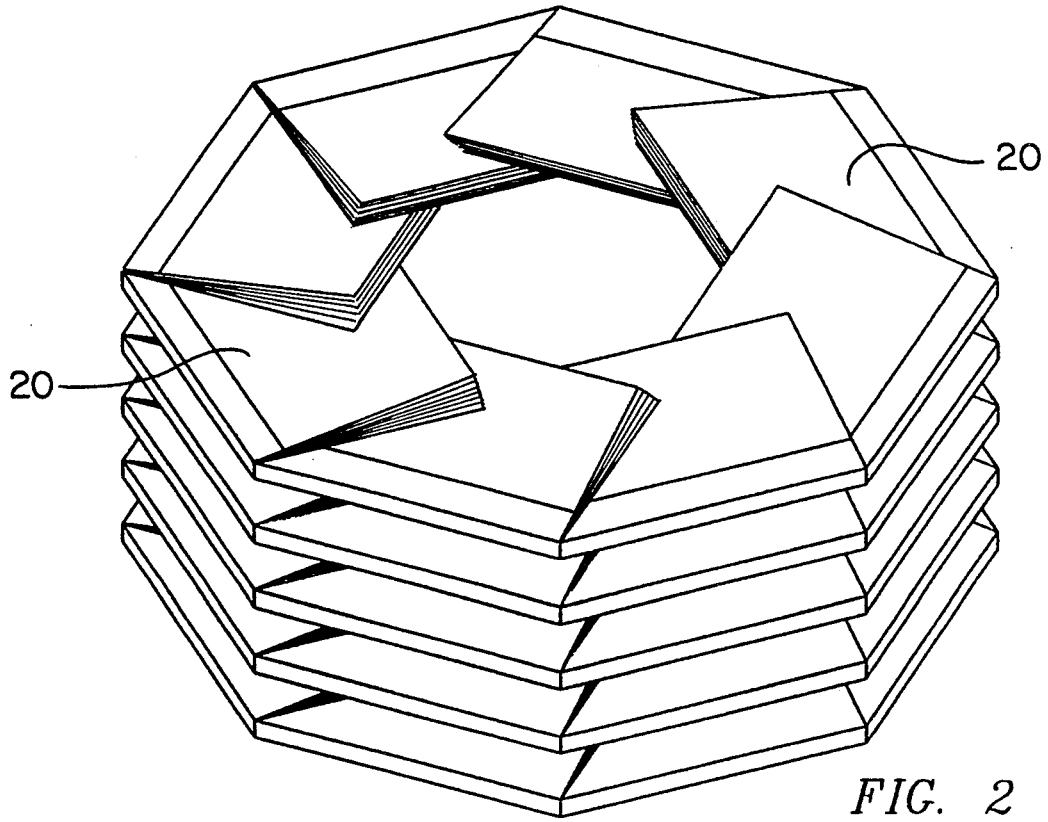
FIG. 2 is a perspective view of the contents of the device for storing photos.
Figure 3:
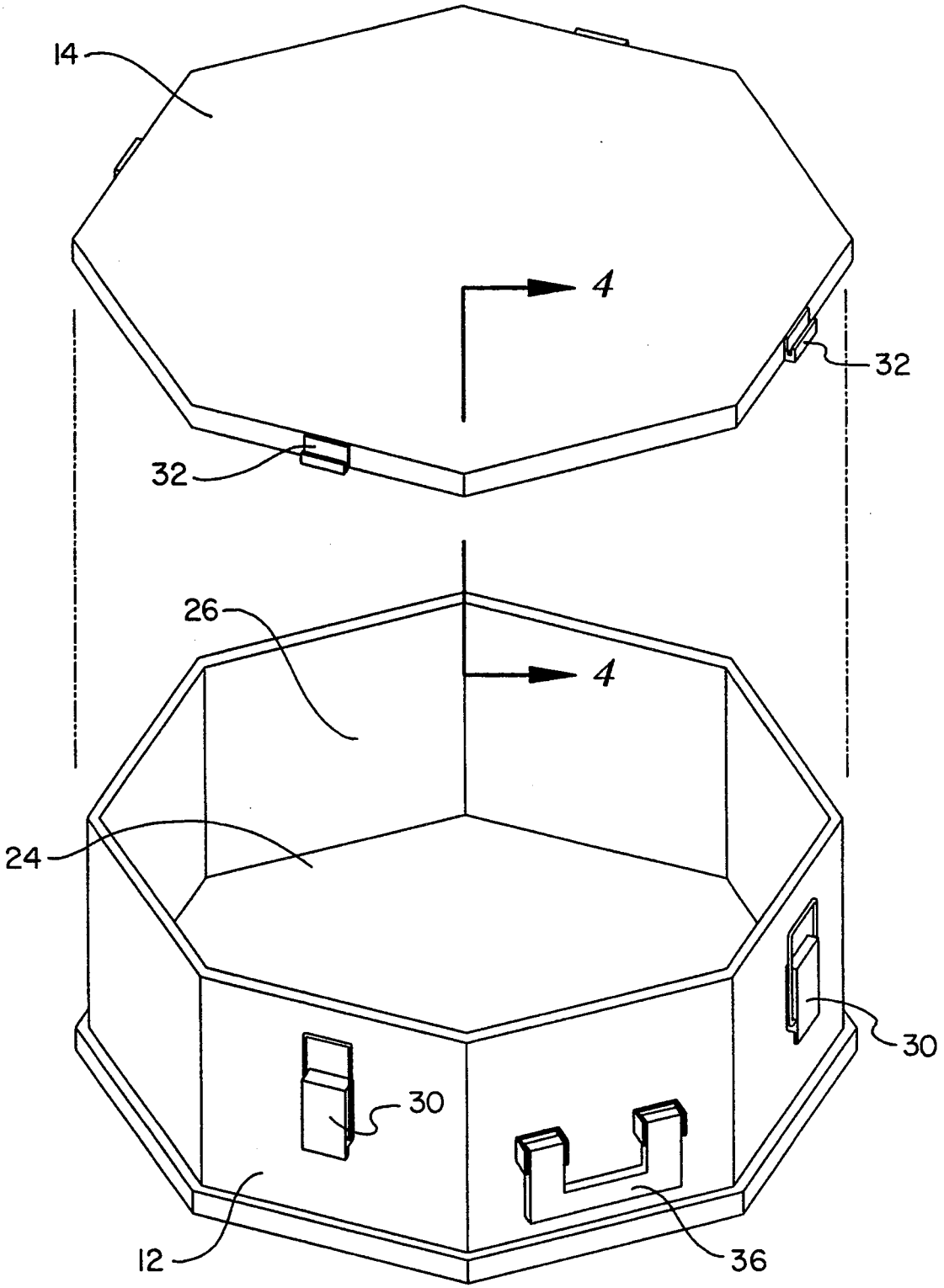
FIG. 3 is an exploded perspective view of the device for storing photos constructed in accordance with the principles of the present invention.

In operation and use, a first ring is provided with 8 books 20. Each of the 8 books is mounted upon its individual planar segment as shown in FIG. 2. A locking post 22 is then mounted over the pins of each segment. With each support plate or ring retaining 8 books with locking posts, the assembly is placed within the container upon the lower wall. A second assembly of support plate ring with books in locking plates is stacked thereon. Three additional ring shaped support plates are then mounted within the container for a total of 5 sets of 8 books for a total of 40 books of photographs. It should be interested that the particular size and numbers utilized in describing this invention are for illustration purposes only and represent the preferred embodiment or best mode for practicing the invention. A wide variety of number, sizes and sizes could readily be utilized within the scope of the invention.

Preferably, the eight-sided polygon shape design photograph album will hold 500 to 2,000 pictures up to 4 inches×6 inches in size and be made of aluminum and sealed air tight. Therefore, it is both water and fire proof. The picture envelopes or books are attached to a 16.00 inch plastic plate in a polygon shape, which can be taken out of its shell and passed around.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container system for the storage of photographs and like articles comprising, in combination:

a container having a lower wall in an octagonal configuration with upstanding rectangular side walls;

a cover having an octagonal configuration of a size and shape to overly the container and seal it;

a plurality of similarly sized and shaped octagonal support plates, each with eight similar linear segments, each of the segments having a pair of spaced, upstanding pins, the plates adapted to overlie each other in a stacked orientation within the container;

a plurality of books of transparent sheets to receive photographs, each book having a spine coupling the sheets, each spine having spaced apertures receivable upon a pair of pins whereby eight books may be positioned and coupled to the pins of the eight segments of each support plate; and a plurality of locking posts equal in number to the segments, each locking post being of a size and shape to correspond to the segments, each locking post having a pair of recesses adjacent to its ends to receive the pins with the spine of a book therebetween.

2. Apparatus for the storage of photographs and like articles comprising:

a container having a lower wall in an octagonal configuration with upstanding rectangular side walls;

a cover having an octagonal configuration of a size and shape to overly the container and seal it;

a plurality of similarly sized and shaped octagonal support plates, each with eight similar linear segments, each of the segments having a pair of spaced, upstanding pins, the plates adapted to overlie each other in a stacked orientation within he container;

a plurality of books of transparent sheets to receive photographs, each book having a spine coupling the sheets, each spine having spaced apertures receivable upon the pins whereby eight books may be positioned and coupled to the pins of the eight segments of each support plate.

3. The apparatus as set forth in claim 2 and further including a plurality of locking posts equal in number to the segments, each locking post being of a size and shape to correspond to the segments, each locking post having recesses to receive the pins with the spine of a book therebetween.

* * * * *